US005649872A

United States Patent [19]

Antonious

[11] Patent Number: 5,649,872

[45] Date of Patent: Jul. 22, 1997

[54] IRON TYPE GOLF CLUB HEAD WITH IMPROVED VIBRATION AND SHOCK REDUCTION STRUCTURE

[76] Inventor: Anthony J. Antonious, 7738 Calle Facil, Sarasota, Fla. 34238

[21] Appl. No.: 612,799

[22] Filed: Mar. 11, 1996

[51] Int. Cl.[6] ..... A63B 53/04

[52] U.S. Cl. ..... 473/332; 473/350

[58] Field of Search ..... 473/324, 329, 473/332, 290, 291, 334, 341, 347, 348, 349, 350; D21/220

[56] References Cited

U.S. PATENT DOCUMENTS

| | | | |
|---|---|---|---|
| 3,814,437 | 6/1974 | Winquist | 473/350 |
| 4,355,808 | 10/1982 | Jernigan | 473/350 |
| 4,826,172 | 5/1989 | Antonious | 473/350 |
| 4,915,386 | 4/1990 | Antonious | 473/350 |
| 4,919,430 | 4/1990 | Antonious | 473/350 |
| 4,919,431 | 4/1990 | Antonious | 473/350 |
| 4,932,658 | 6/1990 | Antonious | 473/350 |
| 5,014,993 | 5/1991 | Antonious | 473/350 |
| 5,242,167 | 9/1993 | Antonious | 473/350 |
| 5,290,032 | 3/1994 | Fenton | 473/332 |
| 5,290,036 | 3/1994 | Fenton | 473/332 |
| 5,316,298 | 5/1994 | Hutin | 473/332 |
| 5,377,985 | 1/1995 | Ohnishi | 473/346 |
| 5,401,021 | 3/1995 | Allen | 473/350 |

*Primary Examiner*—Sebastiano Passaniti
*Attorney, Agent, or Firm*—Aquilino & Welsh

[57] ABSTRACT

An iron type golf club head having an improved vibration and shock reduction structure on the rear surface in the form of upwardly raised configurations which cooperate together to dampen kinetic energy forces when a golf ball is struck.

6 Claims, 4 Drawing Sheets

IRON TYPE GOLF CLUB HEAD WITH IMPROVED VIBRATION AND SHOCK REDUCTION STRUCTURE

BACKGROUND OF THE INVENTION

The present invention relates to iron type golf clubs and in particular to iron type golf club heads having improved vibration and shock reduction structures and increased club head stability and control.

Conventional golf club heads such as iron, metal woods and putters come in various shapes and sizes. There has been a trend in the golf club industry to provide larger golf club heads. However, not much has been done to provide additional meaningful mass in the larger cavities particularly at the rear of the club heads to overcome problems of shock and vibration and to increase stability. To keep the overall club head weights at an acceptable level, there are limits on the size of the larger club heads. Consequently, oversized club heads are made lacking an optimum placement of additional mass behind the club face which creates many problems when a golf ball is struck. This causes serious stabilizing problems and loss of club head control as well as creating an increase in vibration and shock waves which occur when a golf ball is struck. This problem becomes even more pronounced when a golf ball is struck off of the center of percussion, which causes increase club head twisting and torquing.

In recognition of these problems, golf clubs have been made using shock and vibration reducing materials added to the rear cavities on the back of the club heads. These materials include visco-elastic and elastomeric type materials. However, these materials appear to have a limited effect in suppressing vibration and shocks when ball contact is made. In addition, these materials have other draw backs in that they often become dislodged or damaged as a result of the substantial shock which occurs to the club head due to the impact of the ball and also from hitting other clubs in the golfer's bags.

The use of various weight configurations on the back surface of a golf club has been known in the prior art. For example, see the patent to Windquist, U.S. Pat. No. 3,814,437, as well as my own U.S. Pat. Nos. 4,826,172, 4,915,386, 4,919,430, 4,919,431, 4,932,658, 5,014,993, and 5,328,184.

SUMMARY OF THE INVENTION

The present invention relates to an improved iron type golf club head having a vibration and shock reduction structure positioned on the rear surface of the club head and within the cavity structure preferably takes a form of a series of closely spaced, raised projections or ribs, preferably in an array, which are integrally formed with and extend outwardly from the rear surface behind the club face of the club head. Preferable embodiments include coils, rings and concentric geometric designs radiating outwardly from the center of percussion. Embodiments use a series of longitudinal or radial fingers extending across the rear of the club face, including spoke designs opposing bars or ribs, parallel bars, Y-shaped members, T-shaped members, sun burst patterns, and cluster patterns among other designs. The vibration and shock reducing structures may be spaced from or attached directly to the perimeter weight, which forms the cavity. Various other specific embodiments are also contemplated by the present invention as described in detail in the specification.

Accordingly, the present invention is directed to a golf club head that substantially overcomes or obviates the above problems caused by the limitations and disadvantages of the related art.

Among the objects of the present invention is the provision of an iron type golf club head having improved vibration and shock absorbing structures.

Another object of the present invention is an improved iron type golf club head, which enables a player to hit a large number of golf balls without injury to the hands or arms due to vibrational and shock stresses.

To achieve these and other objects and advantages in accordance with purposes of this invention, as embodied and broadly described, the invention is directed to golf club heads, for iron type clubs, metal woods and putter type golf club heads with improved vibration and shock reduction structures for hitting or stroking a golf ball. In particular, the invention is directed to an improved iron type golf club head formed of a club head body having a heel, toe, sole, hosel, ball striking face, top ridge and bottom surfaces and a rear club face section, including a plurality of surface configurations in the form of projections or protrusions for improved club head feel and control and for absorbing shock and minimizing vibrations, torquing and twisting of the club head when off center mis-hits occur when a golf ball is struck. The full scope and wide range of embodiments will become apparent with reference to the following drawings and accompanying specification.

DESCRIPTION OF THE PREFERRED EMBODIMENTS

Figure 1:
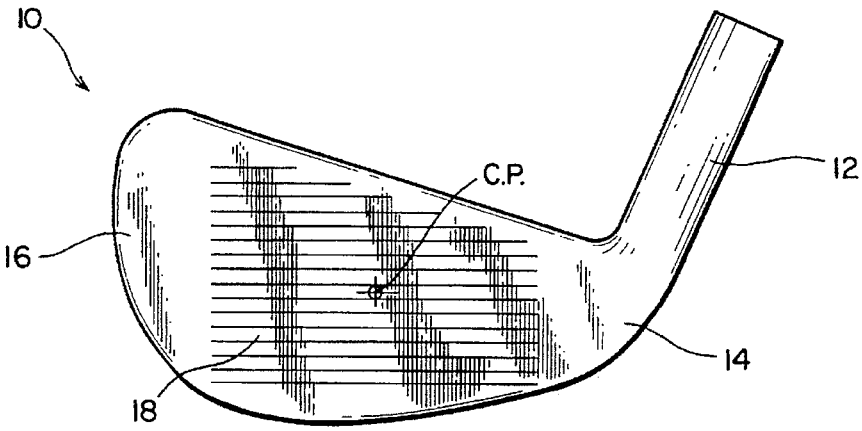
FIG. 1 shows a front elevational view of an iron type golf club head in accordance with the present invention.
Figure 2:
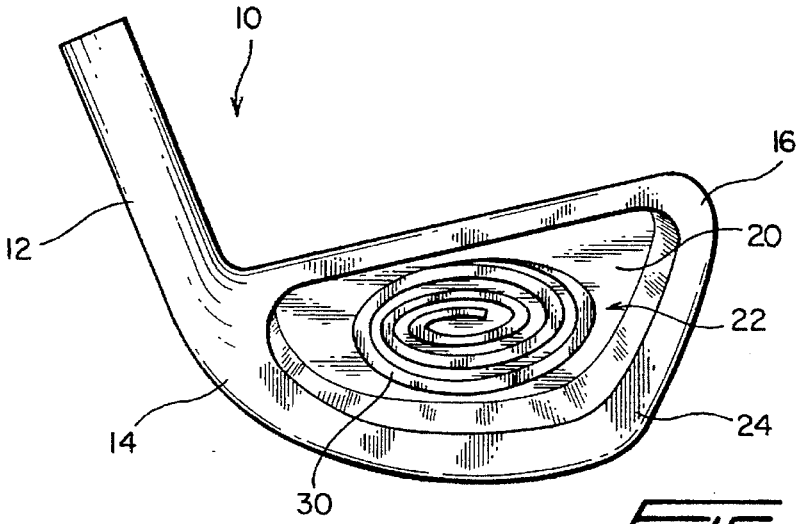
FIG. 2 is a rear elevational view thereof.
Figure 3:
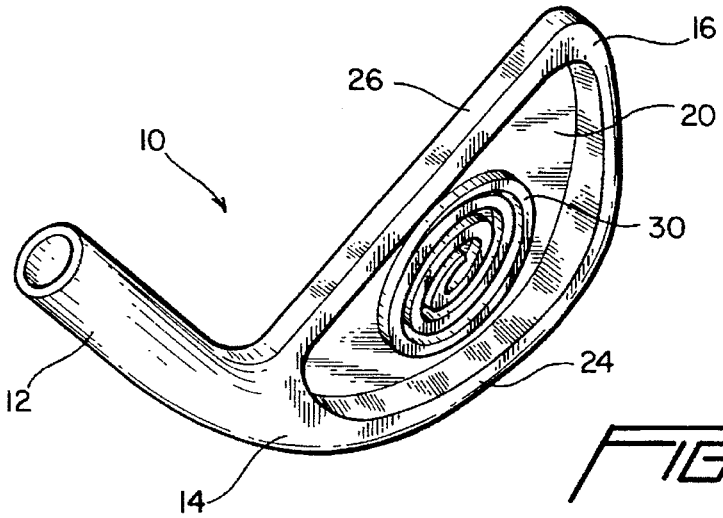
FIG. 3 is a rear perspective view thereof.
Figure 4:
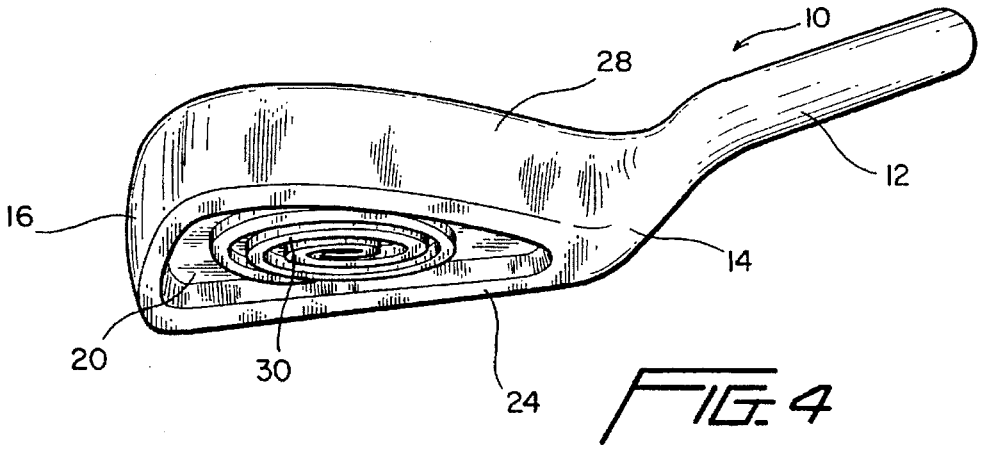
FIG. 4 is a bottom view thereof.
Figure 5:
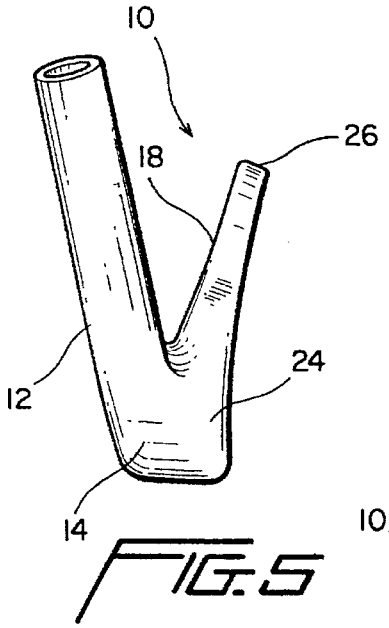
FIG. 5 is an end view.
Figure 6:
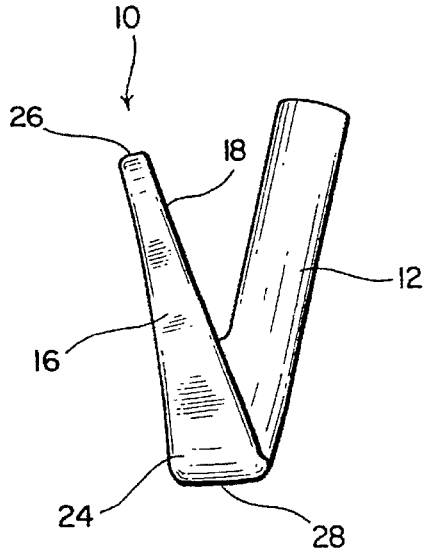
FIG. 6 is an end view taken from the opposite end of FIG. 5.
Figure 7:
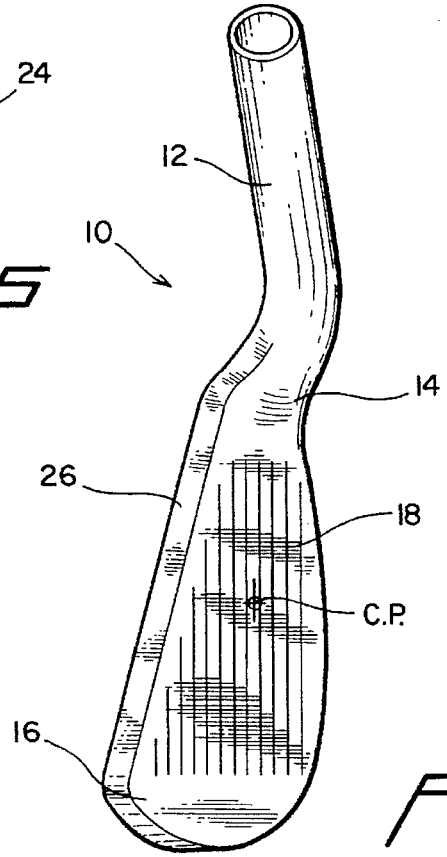
FIG. 7 is a top plan view thereof.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The unusual versatility of structural designs of the golf clubs in accordance with the present invention, specifically with respect to the area behind the club face with the unique configurations of various geometric shapes that best create a system that provides greater cushioning, reduces or eliminates vibrations and shocks, increases club head stability, and is adaptable for all types of golf clubs. A single or combination of various geometric structures can be used for the various types of iron golf club heads, metalwood golf club heads, putter heads and any other special type of golf club heads used in the game of golf.

This unique system substantially controls the kinetic energy produced when a golf club is used to strike a golf ball. Kinetic energy inherently travels in a linear direction or in a straight line. Kinetic energy is the main cause of vibration and shock waves that travel up a golf club shaft to the hands of the golfer. This invention overcomes the negative or adverse effects of kinetic energy, specifically the vibration and shock waves produced thereby, by interrupting or effectively stopping its linear acceleration traveling up the hosel and shaft of the club. This is accomplished by using various combinations and shapes of shock and vibration reduction elements, in a cooperative manner, in forms described in detail hereinbelow, on the back surface of the club head. These elements dramatically reduce the vibrations and shock waves and provide built-in cushioning means on the club head. The combination of these shock and vibration reducing elements not only creates a greater transfer of power at impact, but provides a softer cushion and feel, resulting in more accuracy and greater distance for a given swing effort.

As will become apparent from the descriptions that follow, the golf club heads of the present invention, in addition to the elimination of vibration and shock waves, provide superior structural integrity and weight distribution for a greater power transfer, better feeling and more club head control over conventional golf clubs. The structure of the present invention also increases the integrity and stability by minimizing torqueing and twisting of the club head, permitting a more "square face", solid feeling stroke or swing when ball contact is made, thereby repeatedly providing more accuracy and greater distance.

Club heads, with the improved club head structure of the present invention, also produce more forgiving golf shot patterns when mis-hits occur, particularly with designs of elements which are offset from the center of the club face.

By effectively controlling or eliminating the adverse effects of kinetic energy, this invention permits more of the human source of dynamic power that is available to be combined with said centrifugal force created to obtain optimum results that are not possible in clubs without the unique back configurations of the club face construction. Further, the unique shock and vibration reduction structure creates a better balanced club head which produces numerous advantages over conventional golf club heads.

FIGS. 1–7 illustrate a first embodiment of an improved iron type golf club head 10 in accordance with the present invention including a hosel 12 for connection to a shaft (not shown). The overall club head shape is conventional in design and includes a heel 14, toe 16, ball striking face 18 with a center of percussion CP located thereon; a rear surface 20 and a cavity 22 formed by a rear peripheral weight 24. The club head 10 includes an upper top ridge surface 26 and a bottom surface 28 or sole. A vibration and shock absorbing element 30 is positioned on the rear surface 20 approximately mid-way within the cavity 22 and opposite the center of percussion CP of the club head. In this embodiment, the shock absorbing element 30 takes the form of an oval shaped spiral having progressively larger loops as the spiral approaches the peripheral weight 24. The shock and vibration absorbing element 30 is spaced from the peripheral weight 24 and is generally centered within the cavity 22.

FIGS. 8–15 illustrate various embodiments of iron type golf club heads having shock absorbers formed on the rear surface thereof. It will be appreciated that the iron type golf club heads in these various embodiments are essentially identical to the embodiment shown in FIGS. 1–7 with the exception of the structure of the shock absorber element. For purposes of clarity, only the shock absorbing element and its specific relationship to the other club head body parts will be described in detail.

Figure 8:
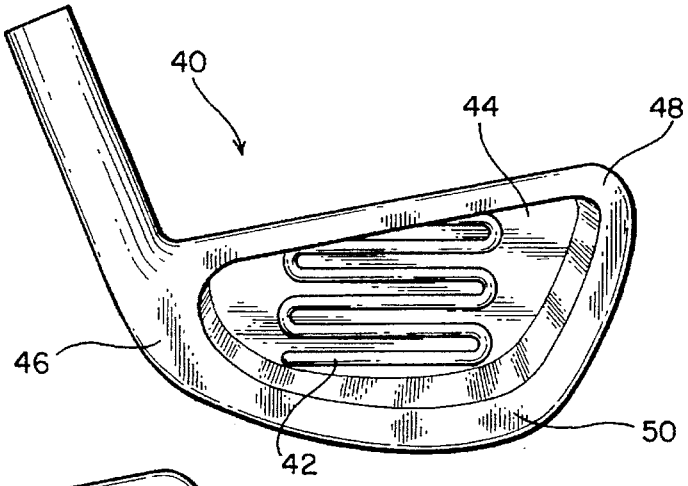
Figure 9:
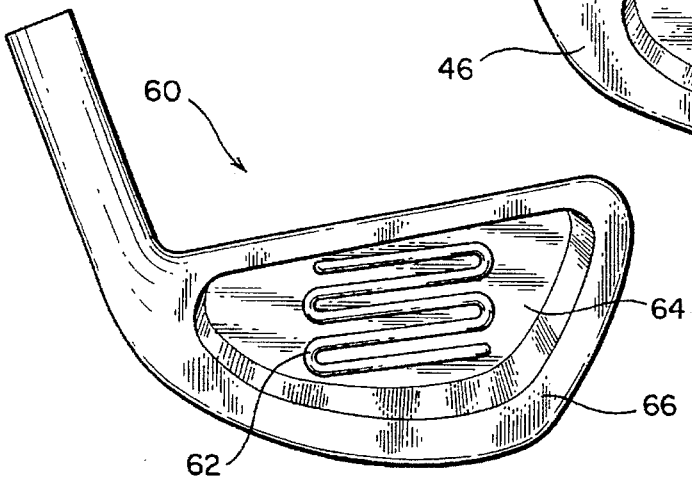
FIG. 9 through FIG. 15 each show a rear elevational view of an alternate embodiment of the present invention.
Figure 10:
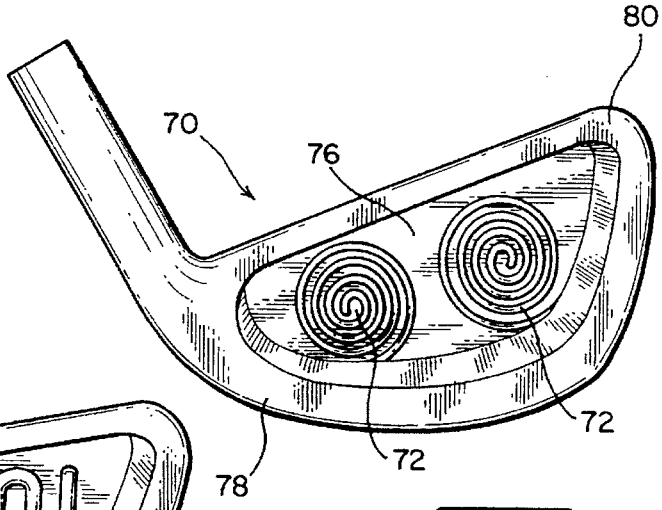
Figure 11:
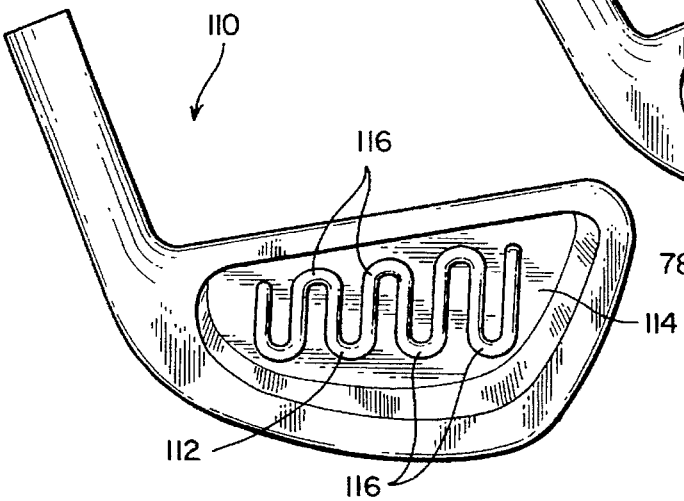

FIG. 8 illustrates a golf club head 40 having a serpentine shock absorbing element 42 formed on rear surface 44 with elongated portions of the element 42 in a heel 46 to toe 48 direction. In this embodiment, the shock absorbing element 42 extends to and attaches with peripheral weight 50 adjacent the top and bottom of the club head 40. FIG. 9 illustrates a golf club head 60 having a serpentine shock absorbing element 62 located on the rear cavity 64 and spaced from the peripheral weight 66. FIG. 10 illustrates a golf club head 70 having a pair of coil-shaped shock absorber elements 72 and 74 located on the rear surface 76 adjacent the heel 78 and toe 80 respectively. Each shock absorbing element 72 and 74 is spaced adjacent to and at either side of the center of percussion of the club head 70. FIG. 11 illustrates an iron type golf club head 110 having a serpentine vibration-shock absorbing element 112 formed on the rear surface 114. The longitudinal axis of each of the serpentine coils 116 of the shock absorbing element 112 extends in a top to bottom direction.

Figure 12:
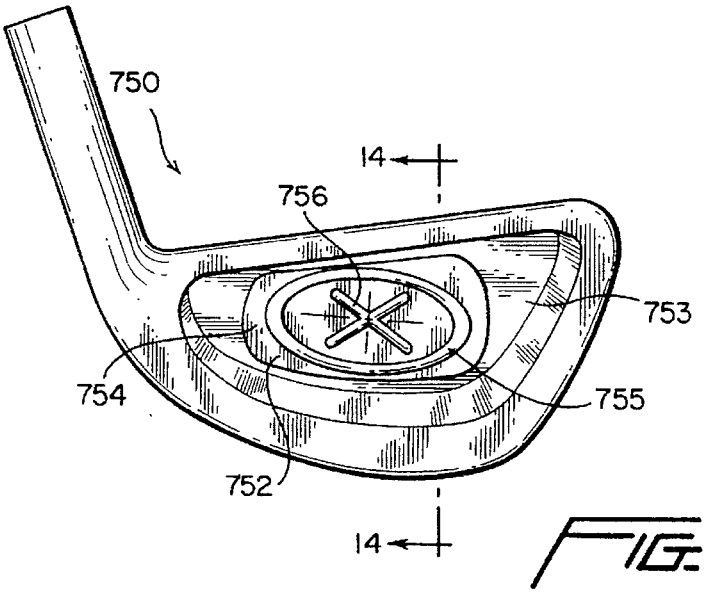
Figure 13:
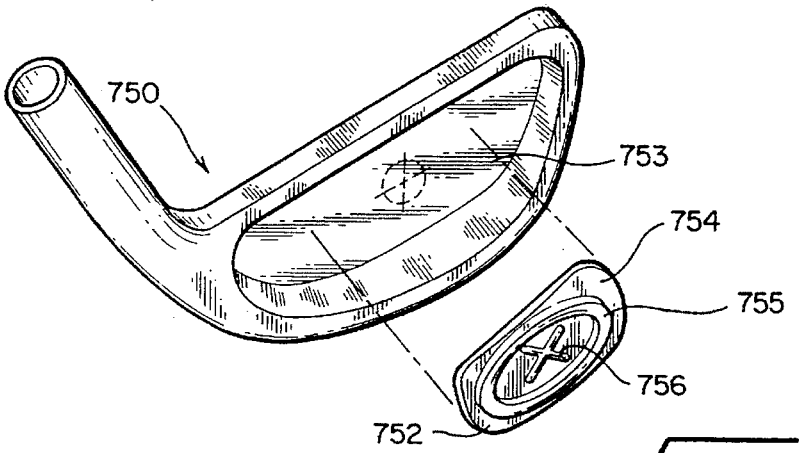
Figure 14:
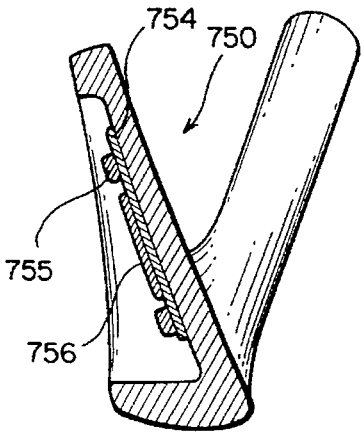

FIGS. 12, 13 and 14 shows another embodiment of an iron type golf club head 750 including a shock and vibration reduction element 752, which is separately attached to the rear surface 753 of the club head by epoxy adhesive or similar substance. The element 752 is preferably formed of a plate 754, a central, oval shaped raised ring 755 and a central geometrical shape 756. By being removable, different size shape and weight elements may be used in order to vary the characteristics of the club head 750.

Figure 15:
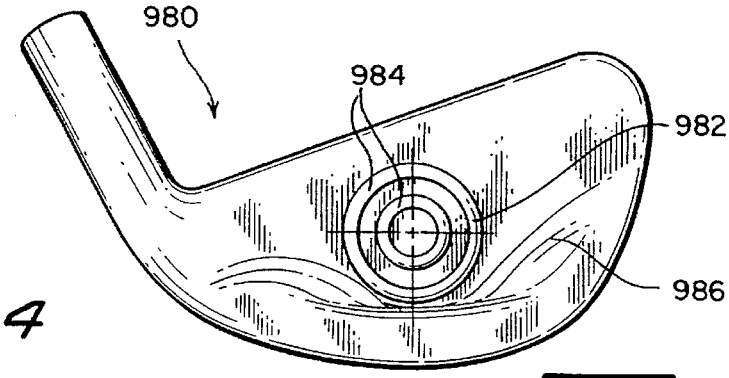

Any of the shock and vibration reducing elements described hereinabove with respect to cavity back, peripheral weighted golf clubs are equally applicable for use with flat back or muscle back golf clubs. For example, FIG. 15 shows a golf club head 980 having a shock and vibration reducing element 982 in the form of concentric circular rings 984 formed on the flat muscle back surface 986 of the club head 980.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A golf club head having a heel, toe, ball striking face with a center of percussion thereon; a top surface; a sole and a rear surface wherein the improvement comprises:

a shock and vibration reduction means on said rear surface; said shock and vibration reduction means on said rear surface being formed of an upwardly raised surface, in at least one surface coil configuration, opposite to and overlaying said center of percussion said coil configuration being spiral shaped; said coil configuration extending outwardly from a center location on said rear surface toward peripheral edges of said club head.

2. The golf club head of claim 1 wherein said coil configuration is further defined as being an oval shaped spiral.

3. The golf club head of claim 1 wherein said coil is continuous starting from a first end located adjacent said center of percussion.

4. The golf club head of claim 1 wherein said rear surface includes a peripheral weight and a cavity formed therefrom, and said coil configuration is spaced from said peripheral weight.

5. The golf club of claim 1 wherein said coil configuration is two spiral shaped coils.

6. The golf club according to claim 1, wherein said shock and vibration means is formed on a separate attachment secured on said rear surface.

* * * * *